US006776684B1

(12) United States Patent
Watkins

(10) Patent No.: US 6,776,684 B1
(45) Date of Patent: Aug. 17, 2004

(54) FIRE CRACKLER STICK

(76) Inventor: James O. Watkins, 9416 Tobin Cir., Patomac, MD (US) 20854

( * ) Notice: Subject to any disclaimer, the term of this patent is extended or adjusted under 35 U.S.C. 154(b) by 56 days.

(21) Appl. No.: 10/265,430

(22) Filed: Oct. 4, 2002

(51) Int. Cl.[7] ..... A63H 33/18; A63H 37/00
(52) U.S. Cl. ..... 446/399; 446/400; 446/475
(58) Field of Search ..... 446/475, 75, 399, 446/400, 404, 418, 420, 398

(56) References Cited

U.S. PATENT DOCUMENTS 825,843 A * 7/1906 Kliemandt ..... 446/398
2,611,999 A * 9/1952 Mikolay ..... 446/400
4,005,657 A * 2/1977 Rothman ..... 102/353
4,799,666 A * 1/1989 Obligio ..... 472/66
5,403,225 A * 4/1995 Watkins ..... 446/475
5,624,295 A * 4/1997 Watkins ..... 446/475
6,299,502 B1 * 10/2001 Cheng ..... 446/224
6,312,310 B1 * 11/2001 Sterr et al. ..... 446/475

* cited by examiner

*Primary Examiner*—Jacob K. Ackun
(74) *Attorney, Agent, or Firm*—Bartlett & Sherer; Ronald B. Sherer

(57) ABSTRACT

A launching device is disclosed which launches snap caps against a hard surface, such as a wall or ceiling, with sufficient force so as to "pop" the caps like tiny firecrackers. In one embodiment, the launcher simultaneously launches confetti into the air so as to create an effect of both sight and sound.

15 Claims, 1 Drawing Sheet

FIRE CRACKLER STICK

BACKGROUND

An entertainment product called "Snap Caps" or "Snappers" has been long known. Such "caps" comprise tissue paper wrapped around chips impregnated with a compound which make a "snapping" or "popping" sound when they are impacted, such as by stepping on them, or by throwing them downwardly very forcefully against a solid floor. However, they are too lightweight to pop if thrown upwardly to a ceiling, or if thrown horizontally against a surface such as a wall unless the wall is only a few feet away. In addition, such caps do not produce any visual effect, only a sound effect.

SUMMARY

The present invention makes it possible to activate such caps against a ceiling or wall from many feet away, and to produce both an audible sound as well as an accompanying visual display.

DETAILED DESCRIPTION

Figure 1:
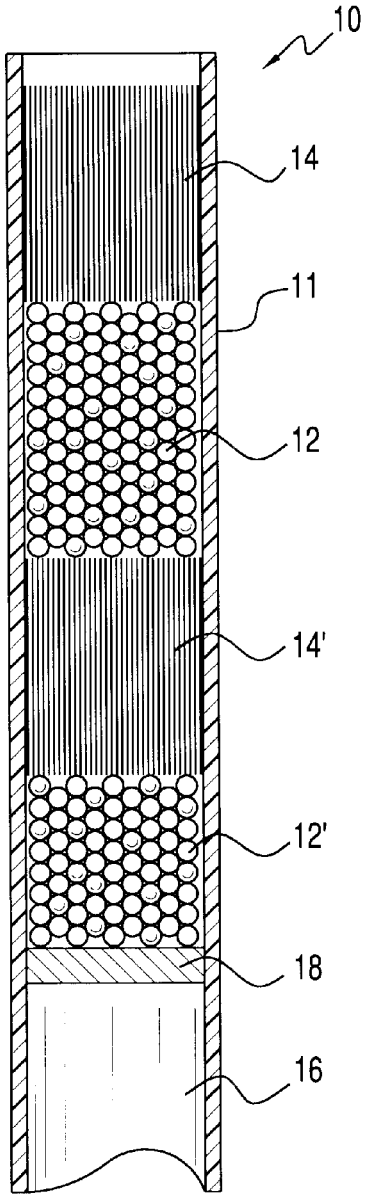
FIG. 1 is a schematic side elevational view of one embodiment of the present invention utilizing a clear plastic tube for clarity.

FIG. 1 schematically illustrates the invention as comprising a hollow launching tube 10 which may be composed of clear or opaque plastic, cardboard, rolled paper or other lightweight material. Tube 10 contains a plurality of caps such as 10 or more per layer in at least one or more layers such as layers 12 and 12'. In addition, tube 10 preferably contains one or more layers of confetti such as layers 14 and 14'.

Depending upon the length of the tube portion 10 containing the caps and confetti, the tube may also include a lower or handle portion 16, and portion 16 may or may not be separated from the upper portion by a plug or stopper 18. For example, the entire tube may be as short as 6" without a stopper and with the lower part used as a handle portion. Alternatively, in one preferred embodiment, the cap-containing portion 10 may have an empty lower tube portion 16 such that the total tube comprises a total length in the order of 10 to 20 inches. In a further preferred embodiment, lower tube portion 16 may be filled with one or more additional layers of caps and confetti which may be launched after the caps and confetti in upper tube portion 10 have been launched as will be further described hereinafter.

In use, the tube is grasped at its lower or handle portion, and the tube is waved sharply with the forearm and wrist such as to create a substantial centrifugal force. This substantial force propels the caps, and the confetti, out of the tube at a very high velocity which is much greater than the velocity of throwing the lightweight caps by hand. As a result, the caps hit a designated solid surface with great impact such that they produce repeated sounds of "popping", and the confetti is also ejected from the tube which creates an accompanying visual effect. For example, the caps may be projected with such velocity as to hit a ceiling over 15 feet high, or a distant wall which may be 20 or more feet away from the user.

Launching tube 10 may have parallel walls 11 as illustrated in FIG. 1, or it may have diverging walls 11 as illustrated and further described in U.S. Pat. No. 5,556,319 which is hereby incorporated by reference. If the tube comprises both an upper portion 10, and a lower portion 16 also containing caps and/or confetti, the user may grasp a first end of the tube and launch the caps from the other end. Then, the user may reverse the tube and grasp the other end and launch the caps from the first end, such as further described in U.S. Pat. No. 5,403,225 hereby incorporated by reference.

While various types of confetti may be used, the most preferred embodiment is to use FLUTTER FETTI® brand of confetti such as described in U.S. Pat. Nos. 5,352,148, 5,643,042 and 5,709,584 which are hereby incorporated by reference. Such confetti is rectangular in shape and may be inserted into the tube with or without end wrappers such as disclosed in U.S. Pat. No. 5,709,584. For maximum fluttering action it has been determined that the rectangular confetti should have length and width dimensions such as those disclosed in the above-referenced patents, and preferably, the confetti bundles should be partially wrapped as disclosed in U.S. Pat. No. 5,709,584.

While the use of confetti along with the caps has been described because of the dual effect of both sound and sight, the present invention includes the use of caps alone in the launch tube. That is, it has been discovered that the caps may be "popped" by ejection from the launch tube under substantial centrifugal force which is not in anyway possible by hand throwing. As a result, the caps may be popped against a ceiling in the range of 8 to 20 feet in height, and against a side wall which may be in the range of up to 40 feet away from the user. Obviously, this is clearly not possible with hand throwing.

Figure 2:
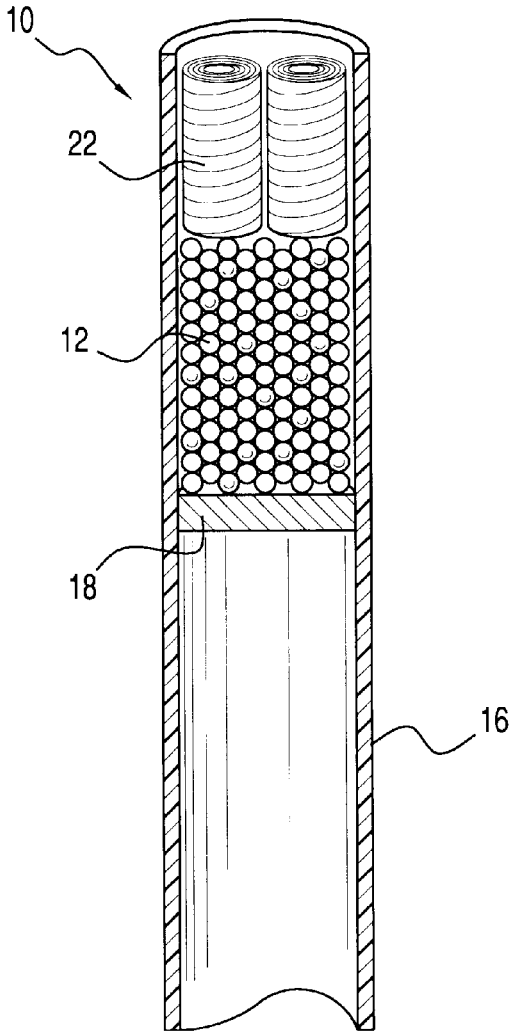
FIG. 2 is a schematic side elevational view of a second embodiment also illustrated with a clear plastic tube.

Instead of confetti, or in addition to confetti, one or more layers of wound streamers 22 may be included in the tube as shown, for example, in FIG. 2 and in U.S. Pat. No. 5,354,227 which is hereby incorporated by reference. Preferably, the streamers are sized relative to the diameter of the tube so as to be compressed and exert a predetermined amount of frictional force against the inner walls of the tube as more fully described in Application Ser. No. 09/790,981 which is hereby incorporated by reference. As such, they constitute a "plug" such that they prevent the other components in the tube from falling out when the end of the tube is pointed downwardly. Moreover, the centrifugal force which is generated by waving the tube in an arcuate path must exceed this predetermined frictional force. Thus, the force and velocity of the caps exiting the tube may be predetermined, and may be made such as to "pop" the caps against ceilings or walls which are many feet away from the user. Instead of streamers forming a "plug" in the open end of the launching tube, stacks or bundles of confetti may be forced into the end of the tube so as to provide frictional resistance and constitute a plug. Alternatively, the plug may be composed of other resilient material such as foam plastic or rubber or the like.

From the foregoing description of several preferred embodiments, it will be apparent that numerous variations may be made in the invention by those skilled in the art. Accordingly, it is to be understood that the foregoing description of several preferred embodiments is intended to be illustrative rather than exhaustive of the principles of the invention, and that the scope of the invention is not intended to be limited other than as set forth in the following claims interpreted under the doctrine of equivalents.

What is claimed is:

1. A method of popping snap caps comprising:

(a) loading a plurality of snap caps into an elongated hollow tube;

(b) grasping said elongated hollow tube at one end and waving the other end of said tube in an arcuate path so as to develop substantial centrifugal force such as to eject said snap caps from said tube at high velocity; and (c) directing the ejected snap caps in a direction so as to impact a solid surface so as to produce popping of said snap caps.

2. The method of claim 1 wherein step (a) of loading said caps into said tube also includes loading confetti into said tube so as to produce both sound and visual effects.

3. The method of claim 1 wherein step (a) includes loading at least one spiral wound streamer into said tube.

4. The method of claim 1 wherein step (c) comprises directing said caps against a ceiling.

5. The method of claim 1 wherein step (c) comprises directing said caps against a spaced-apart wall.

6. The method of claim 2 wherein step (a) of loading confetti comprises loading said confetti into said tube such as to form a plug frictionally resistant to the ejection of said caps until a predetermined centrifugal force is obtained by waving said tube in an arcuate path.

7. The method of claim 3 wherein step (a) comprises loading at least one of said streamers of a size and shape such as to constitute a plug against the ejection of said caps until a predetermined centrifugal force is reached by arcuate movement of said tube.

8. An entertainment device comprising:

(a) an elongated hollow tube;

(b) a plurality of snap caps in said tube; and (c) said elongated tube having a length sufficient so as to eject said caps under centrifugal force with sufficient force against a ceiling or wall so as to cause said caps to pop when said tube is waved in an arcuate path.

9. The entertainment device of claim 8 wherein said elongated tube contains a plurality of confetti in addition to said plurality of caps.

10. The entertainment device of claim 8 wherein said elongated tube contains at least one rolled streamer in addition to said plurality of caps.

11. The entertainment device of claim 9 wherein said elongated tube further contains at least one roiled streamer.

12. The entertainment device of claim 8 including means forming a plug frictionally engaging said tube with a predetermined amount of frictional force to be overcome by centrifugal force before said plurality of caps can be ejected from said tube.

13. The entertainment device of claim 8 wherein said plurality of caps comprise a layer of caps.

14. The entertainment device of claim 9 wherein said plurality of confetti comprise a layer of confetti.

15. The entertainment device of claim 10 wherein said at least one rolled streamer comprises a layer forming a plug engaging said tube.

* * * * *